US006568413B1

(12) United States Patent
Hurskainen

(10) Patent No.: US 6,568,413 B1
(45) Date of Patent: May 27, 2003

(54) APPARATUS FOR PROCESS WASHING

(76) Inventor: Aarne Hurskainen, Peiponkuja 9, FIN-37600 Valkeakoski (FI)

( * ) Notice: Subject to any disclaimer, the term of this patent is extended or adjusted under 35 U.S.C. 154(b) by 0 days.

(21) Appl. No.: 09/806,839

(22) PCT Filed: Sep. 14, 1999

(86) PCT No.: PCT/FI99/00745

§ 371 (c)(1),
(2), (4) Date: Apr. 5, 2001

(87) PCT Pub. No.: WO00/20134

PCT Pub. Date: Apr. 13, 2000

(30) Foreign Application Priority Data

Oct. 5, 1998 (FI) ..... 982146

(51) Int. Cl.[7] ..... B08B 3/02

(52) U.S. Cl. ..... 134/167 R; 134/166 R; 134/169 R

(58) Field of Search ..... 134/166 R, 169 R, 134/167 R, 168 R

(56) References Cited

U.S. PATENT DOCUMENTS

| | | | | |
|---|---|---|---|---|
| 3,033,215 | A | * | 5/1962 | Miller |
| 3,065,760 | A | * | 11/1962 | Cailas |
| 3,090,393 | A | * | 5/1963 | Valentine |
| 3,104,672 | A | * | 9/1963 | Holdren |
| 3,111,954 | A | * | 11/1963 | Duncan |
| 3,522,815 | A | * | 8/1970 | Prange |
| 3,599,871 | A | * | 8/1971 | Ruppel |
| 3,645,452 | A | * | 2/1972 | Stoeckel et al. |
| 3,741,808 | A | * | 6/1973 | Stalker |
| 4,574,825 | A | * | 3/1986 | Haug |
| 5,020,183 | A | * | 6/1991 | Grant, Jr. |
| 5,037,486 | A | * | 8/1991 | Sloan |
| 5,301,702 | A | * | 4/1994 | McKinney |
| 5,392,798 | A | * | 2/1995 | Hirose et al. |
| 5,413,130 | A | | 5/1995 | Maruyama et al. |
| 5,697,392 | A | | 12/1997 | Johnson et al. |
| 5,979,471 | A | * | 11/1999 | Wilby et al. |
| 6,021,793 | A | * | 2/2000 | Moulder |

FOREIGN PATENT DOCUMENTS

| | | | |
|---|---|---|---|
| AU | 233478 | * | 4/1960 |
| EP | 0 027 007 | | 9/1980 |
| EP | 0 160 805 | | 3/1985 |
| NO | 53956 | * | 5/1934 |
| SU | 889129 | * | 12/1981 |

* cited by examiner

*Primary Examiner*—Frankie L. Stinson
(74) *Attorney, Agent, or Firm*—Connolly Bove Lodge & Hutz, LLP

(57) ABSTRACT

The invention relates to an apparatus for process washing, by means of which a process device is washable by a washing device, that moves inside the same, whereby the washing device (1) is connected moveably in connection with the process device by means of fastening means (2) and, whereby the washing medium of the washing device is furthermore arranged to be led at least partly inside the body (1*a*) of the washing device in order to lead the washing medium furthermore to a target by spraying or correspondingly by means of nozzles (1*b*) existing in the body (1*a*) of the washing device. The washing device comprises a body (1*a*), that rotates (z) around an axis (t), that is essentially perpendicular to its longitudinal axis (s). The nozzles (1*b*) of the washing device (1; 1') are arranged at a certain point (x) of the body (1*a; 1a'*) of the washing device in the longitudinal direction (s), in order to enable service and maintenance of the washing device in a centralized manner through a service opening (A) or a like, that is placed at a corresponding point in the process device.

18 Claims, 2 Drawing Sheets

APPARATUS FOR PROCESS WASHING

The invention relates to an apparatus for process washing, by means of which a process device is washable by washing device, that moves inside the same, whereby the washing device is connected moveably in connection with the process device by means of fastening means and, whereby the washing medium of the washing device is arranged to be led at least partly inside the body of the washing device in order to lead the washing medium furthermore to a target by spraying or correspondingly by means of nozzles existing in the body of the washing device, wherein the washing device comprises a body, that rotates around an axis, that is essentially perpendicular to its longitudinal axis.

Figure 1A:
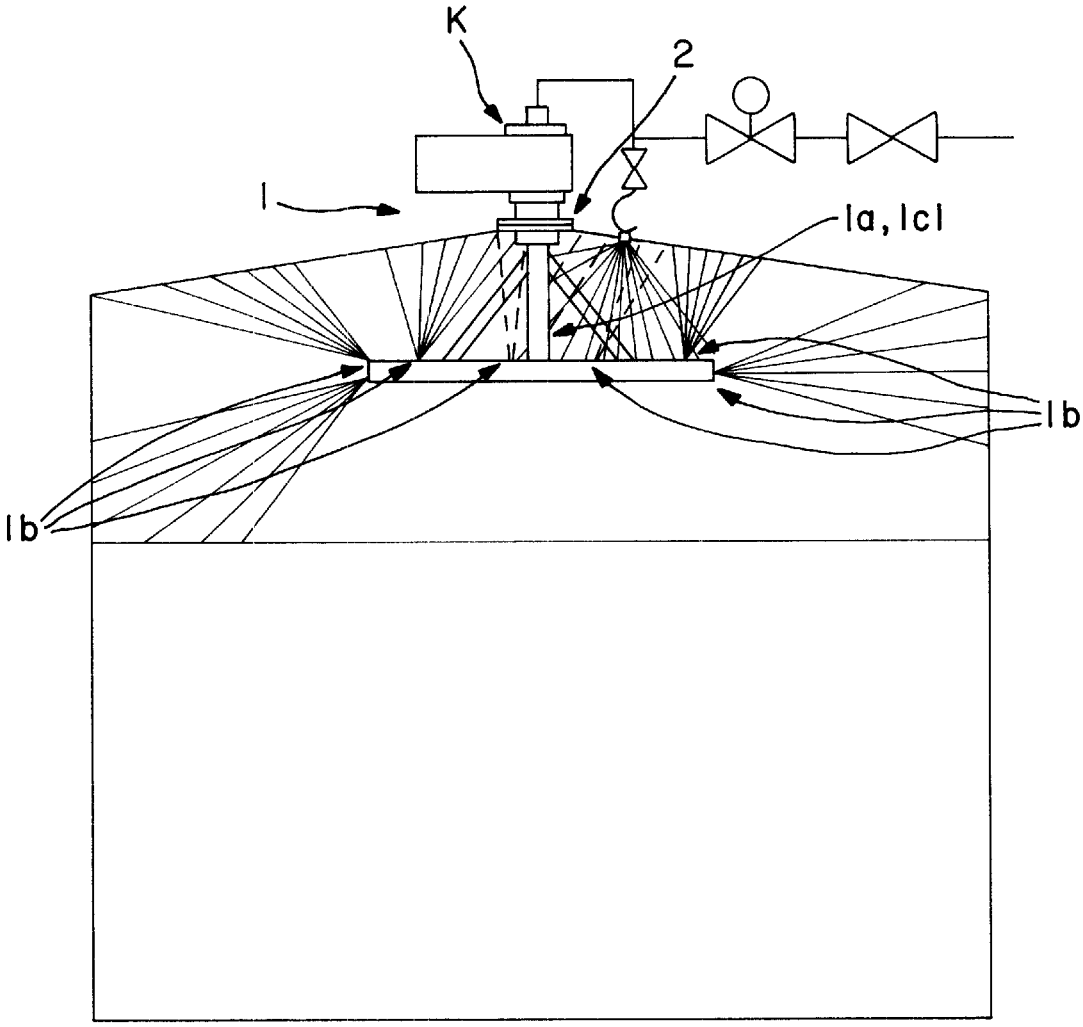
FIG. 1a BACKGROUND ART

Nowadays it is known to use a washing device for process washing e.g. according to FIG. 1*a,* that is equipped with a body, that rotates around an axis, that is essentially perpendicular to its longitudinal axis, which body has the necessary nozzles in order to direct the washing medium, that has been led internally through the body, to the surfaces to be washed of the process device. For this purpose it is known to use most heterogeneous washers, the operating principle of which is to act by influence of the pressure or flow of the washing liquid or, that are moveable by external power.

A problem in use of a process device of the type described above in practice is difficulty of its service and maintenance, because practically all measures demand dismounting of the washing device in question, in order to enable the measures, that the washing device being taken out from the process device needs at each time. Thus in case of even very small malfunctionings, such as single nozzles getting stuck, the dismounting of the washing device causes always disproportionately long interruptions for use in practice. Thus, in case the meaning is to keep a washing device representing todays techniques continuously in optimum condition for use, it requires always interruption of the process for the time of the dismounting, removing, maintenance and remounting of the washing device or otherwise carrying out the measures during optimum periods for the process, which usually happen to take place untimely with a view to personnel working costs.

It is the aim of the invention of the present invention to achieve a decisive improvement in the problems presented above and thus to raise essentially the level of prior art. In order to carry out this aim, the apparatus according to the invention is primarily characterized by, that the nozzles of the washing device are arranged at the certain point of the body of the washing device in the longitudinal direction, in order to enable service and maintenance of the washing device in a cenralized manner through a service opening or a like, that is placed at a corresponding point in the process device.

As the most important advantages of the apparatus according to the invention may be mentioned the simplicity and reliability of its construction and use, thanks to which the invention enables a very easy and quick way to maintain the washing device in optimum condition for use with as less manual work as possible. Thanks to the invention it is thus possible to minimize the service and maintenance costs, because interruptions due to present techniques are not caused for the production as the service and maintenance of the washing device takes place "inside the process device" without laborious dismounting measures. The apparatus according to the invention is profitably structured in a way, that the nozzles of the washing device are placed at the opposite ends of the horizontal body, in which case all the necessary measures may be carried out simply and quickly by inclining the body inside the process device through the service opening and by treating e.g. each branch of the washing device at a time as needed.

Figure 2:
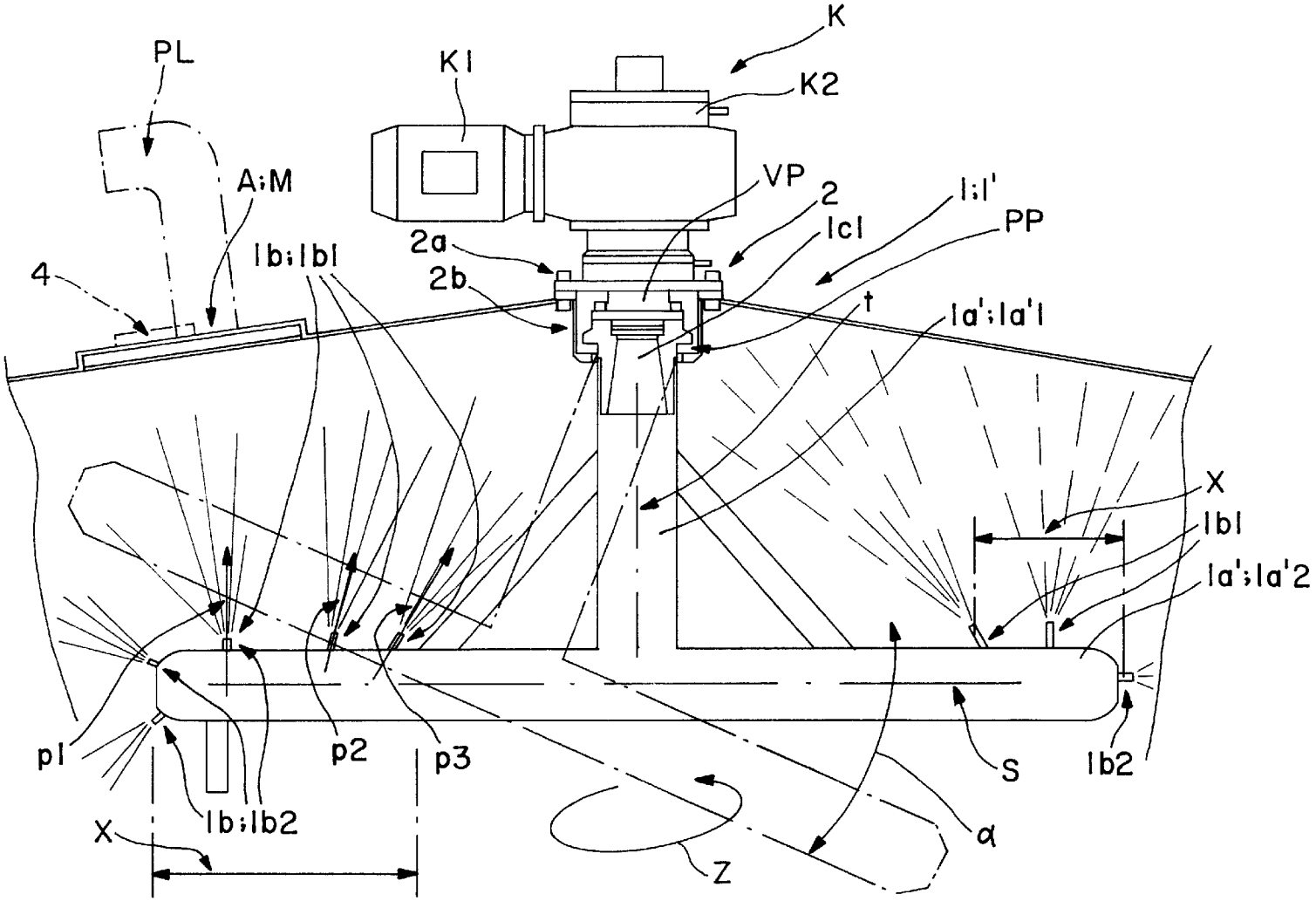

In the following description the invention is described in detail with reference to the appended drawings, in which FIG. 1*a* shows a usual washing device used for process washing and FIG. 2 shows an advantageous solution according to the invention for a corresponding purpose than the one shown in FIG. 1.

The invention relates to an apparatus for process washing, by means of which a process device is washable by a washing device, that moves inside the same, whereby the washing device 1 is connected moveably in connection with the process device by means of fastening means 2 and, whereby the washing medium of the washing device is furthermore arranged to be led at least partly inside the body 1*a* of the washing device in order to lead the washing medium furthermore to a target by spraying or correspondingly by means of nozzles 1*b* existing in the body 1*a* of the washing device. The washing device comprises a body 1*a,* that rotates z around an axis t, that is essentially perpendicular to its longitudinal axis s. The nozzles lb of the washing device 1; 1' are arranged at a certain point x of the body 1*a;* 1*a*' of the washing device in the longitudinal direction s in order to enable service and maintenance of the washing device in a centralized manner through a service opening A or a like, that is placed at a corresponding point in the process device.

With reference particularly to FIGS. 1*a* and 2, the body 1*a*' of the washing device comprises an essentially vertical center body 1*a*'1 and a horizontal body 1*a*'2 connected to the above essentially perpendicularly. In the embodiment shown in FIG. 2 the nozzles 1*b* are placed essentially at the opposite ends of the horizontal body 1*a*'2.

Furthermore as an advantageous embodiment, particularly the nozzles 1*b*1 placed next to each other at the top and/or bottom edge of the horizontal body 1*a*'2 are directed at mutually deviating directions p1, p2, p3 in order to extend the coverage of the spraying screen.

Furthermore as an advantageous embodiment, the washing device is arranged to be serviced and maintained through the service opening A arranged to the process device by at least partly inclining a the washing device 1' inside the process device.

Furthermore as an advantageous embodiment, the invention is applied in connection with a washing device, that is moveable by means of a driving device K, wherein at least a part of the supply assembly Icl for the washing medium is led totally through the washing device, such as through its body 1*a* and at least partly inside the fastening means 2, such as an attachment frame 2*b* fastened with screws 2*a* or a like, and inside the driving device K, such as a motor K1 and gear K2.

Particularly in connection with this type of structure, to the attachment frame 2*b* and the center body 1*a*'1 there has been arranged a counterpart surface arrangement PP, such as a counterpart flange assembly with a clearance or a like, in order, to prevent falling down of the body 1*a*'1 of the washing device and to enable inclining a of the same inside the process device.

Furthermore as an advantageous embodiment, the center body 1*a*'1 of the washing device is connected to the power transmitting end VP of the driving device K by means of quick-release principle, such as by a two-ended threading, a bayonet coupling or correspondingly.

In addition to the above, as an advantageous embodiment the service opening A is closed by a manhole M equipped with monitoring means 4, such as an observation hatch, a monitoring camera or a like. It is naturally possible to equip the service opening A also with a manhole M equipped with a process apparatus PL, such as a draught, a sampling fitting or a like.

It is obvious, that the invention is not limited to the embodiments presented or described above, but it can be modified within the basic idea of the invention to a great extent. First of all the body of the washing device may be, differing from the T-shape shown e.g. in FIG. 2, L-shaped or it may be formed of three or more horizontal bodies, that are attached to the center body radially. It is furthermore naturally possible to exploit an auxiliary washer as shown e.g. in FIG. 1*a,* in order to wash the washing device itself by a flow of a washing medium being led from the nozzle in question. It is furthermore naturally clear, that the apparatus according to the invention may be adapted in connection with a washing device, that is moveable in any possible way so, that the presented embodiments are intended only to show certain common ways based on traditional washing device structures to carry out the invention.

What is claimed is:

1. A washing apparatus suitable for washing an internal portion of a process device, the apparatus comprising:

a washing device that moves inside a housing of the process device and which is capable of being moveably connected by fastening means to the housing of the process device, wherein a washing medium of the washing device is led at least partly inside a body of the washing device and to a target by spraying through nozzles in the body of the washing device, wherein the body of the washing device rotates around an axis essentially perpendicular to a longitudinal axis of the washing device, wherein the body is adapted and arranged to be connected to the housing of the process device by an operating opening in the housing, wherein the body of the washing device comprises an essentially vertical center body and a horizontal body connected essentially perpendicularly to the vertical center body, and a service opening in the housing that is placed apart from the operating opening to enable service and maintenance of the nozzles of the washing device, wherein the nozzles are placed essentially at opposite ends of the horizontal body and the service opening is placed essentially at a corresponding distance from the operating opening.

2. The apparatus according to claim 1, wherein the washing device is arranged to be serviced and maintained through the service opening by at least partly inclining the washing device inside the housing.

3. The apparatus according to claim 2, further comprising a driving device including a motor operatively connected to a gear, wherein at least a part of a supply assembly for the washing medium is led totally through the body of the washing device and at least partly inside the fastening means, wherein the fastening means includes an attachment frame fastened with screws; and a counterpart surface arrangement including a counterpart flange assembly with a clearance operatively arranged with respect to the attachment frame and the center body, wherein the counterpart surface arrangement prevents a falling down of the center body of the washing device and enables an inclining of the center body of the washing device inside the housing.

4. The apparatus according to claim 3, wherein the center body of the washing device is connected to a power transmitting end of a driving device by a means for quick-release.

5. The apparatus according to claim 4, wherein the service opening is closed by a manhole equipped with a process apparatus.

6. The apparatus according to claim 3, wherein the service opening is closed by a manhole equipped with a process apparatus.

7. The apparatus according to claim 2, wherein the center body of the washing device is connected to a power transmitting end of a driving device by a means for quick-release.

8. The apparatus according to claim 7, wherein the service opening is closed by a manhole equipped with a process apparatus.

9. The apparatus according to claim 2, wherein the service opening is closed by a manhole equipped with a process apparatus.

10. The apparatus according to claim 1, further comprising a driving device including a motor operatively connected to a gear, wherein at least a part of a supply assembly for the washing medium is led totally through the body of the washing device and at least partly inside the fastening means, wherein the fastening means includes an attachment frame fastened with screws; and a counterpart surface arrangement including a counterpart flange assembly with a clearance operatively arranged with respect to the attachment frame and the center body, wherein the counterpart surface arrangement prevents a falling down of the center body of the washing device and enables an inclining of the center body of the washing device inside the housing.

11. The apparatus according to claim 10, wherein the center body of the washing device is connected to a power transmitting end of a driving device by a means for quick-release.

12. The apparatus according to claim 11, wherein the service opening is closed by a manhole equipped with a process apparatus.

13. The apparatus according to claim 10, wherein the service opening is closed by a manhole equipped with a process apparatus.

14. The apparatus according to claim 1, wherein the center body of the washing device is connected to a power transmitting end of a driving device by a means for quick-release.

15. The apparatus according to claim 14, wherein the service opening is closed by a manhole equipped with a process apparatus.

16. The apparatus according to claim 1, wherein the service opening is closed by a manhole equipped with a process apparatus.

17. The apparatus according to claim 1, wherein the service opening is closed by a manhole equipped with one of a vent or a sampling fitting.

18. A process device, comprising the washing device of claim 1 arranged inside a housing of the process device.

* * * * *